US007040591B1

(12) United States Patent
Simon

(10) Patent No.: US 7,040,591 B1
(45) Date of Patent: May 9, 2006

(54) ADJUSTABLE BOOK HOLDER ASSEMBLY

(76) Inventor: David F. Simon, 8800 MIdstate Dr., Mecosta, MI (US) 49332

( * ) Notice: Subject to any disclaimer, the term of this patent is extended or adjusted under 35 U.S.C. 154(b) by 0 days.

(21) Appl. No.: 10/758,681

(22) Filed: Jan. 15, 2004

Related U.S. Application Data

(60) Provisional application No. 60/531,115, filed on Dec. 20, 2003.

(51) Int. Cl.
*A47B 96/04* (2006.01)

(52) U.S. Cl. ..... 248/458; 248/122.1; 248/125.9

(58) Field of Classification Search ..... 248/441.1, 248/451, 452, 453, 458, 122.1, 125.7, 125.8, 248/183.3, 186.2, 131, 130, 183.1, 183.2, 248/188.1
See application file for complete search history.

(56) References Cited

U.S. PATENT DOCUMENTS

| | | | | | |
|---|---|---|---|---|---|
| 586,391 | A * | 7/1897 | Pinney et al. | ..... | 248/452 |
| 2,104,072 | A * | 1/1938 | Carr | ..... | 248/458 |
| 2,424,222 | A * | 7/1947 | Brown et al. | ..... | 248/276.1 |
| 2,485,135 | A * | 10/1949 | Blumenstock | ..... | 248/453 |
| 2,771,705 | A * | 11/1956 | Rettinger | ..... | 248/445 |
| 3,119,588 | A * | 1/1964 | Keats | ..... | 248/158 |
| 3,586,852 | A * | 6/1971 | Bradley | ..... | 362/280 |
| 3,889,910 | A * | 6/1975 | Walters | ..... | 248/122.1 |
| 4,549,366 | A * | 10/1985 | Gerding et al. | ..... | 38/102.2 |
| 5,161,766 | A * | 11/1992 | Arima | ..... | 248/447 |
| 5,199,680 | A * | 4/1993 | Rivera | ..... | 248/441.1 |
| 5,671,900 | A * | 9/1997 | Cutler | ..... | 248/451 |
| 6,209,835 | B1 * | 4/2001 | Walrath et al. | ..... | 248/276.1 |

FOREIGN PATENT DOCUMENTS

| | | | |
|---|---|---|---|
| WO | WO9909859 | * | 3/1999 |

* cited by examiner

*Primary Examiner*—Ramon O Ramirez
(74) *Attorney, Agent, or Firm*—John R. Benefiel

(57) ABSTRACT

A book support is mounted to a vertical upright assembly affixed to a weighted base. The book support is selectively positionable in various horizontal positions by swinging a horizontal swing arm articulated with a pivot connection to a one end of a horizontally extending segment of an upper member of the upright assembly. The swing arm is also rotatable about its own axis longitudinal by a pivot connection with the horizontal segment of an upper member of the upright assembly. An adjustable pivot connection also mounts the book support to a free end of the swing arm allowing reorientation of the book support about an axis normal to the longitudinal axis of the swing arm. A book shelf-rack support structure is fitted over the upright and has book shelves, racks mounted thereto. A cast iron platform weights the base and has a molded plastic cover.

11 Claims, 6 Drawing Sheets

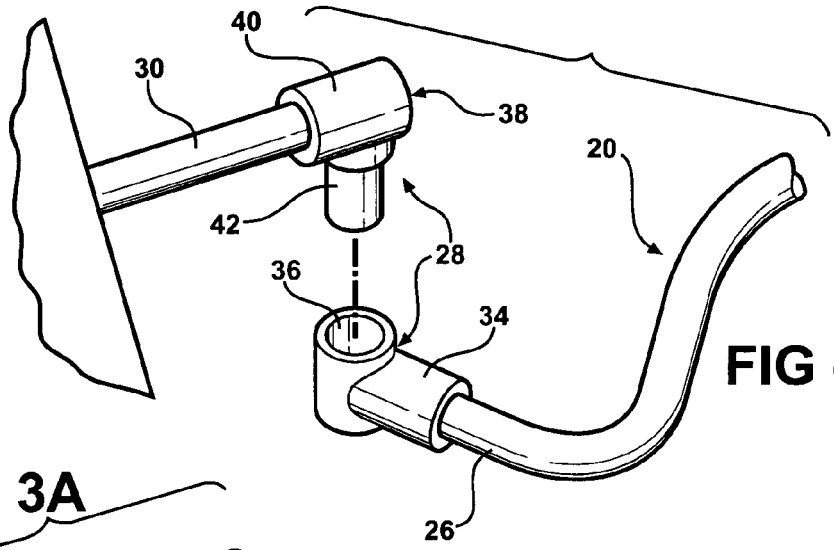
FIG - 3
FIG - 3A
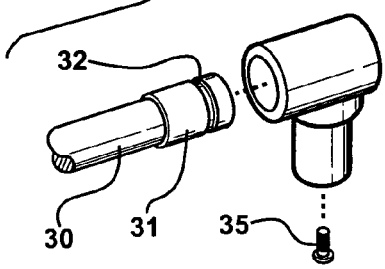
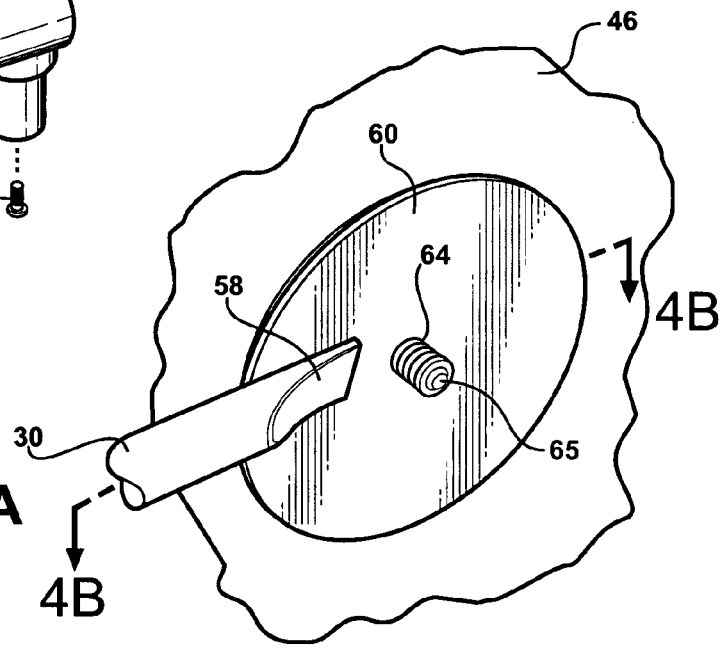
FIG - 4A
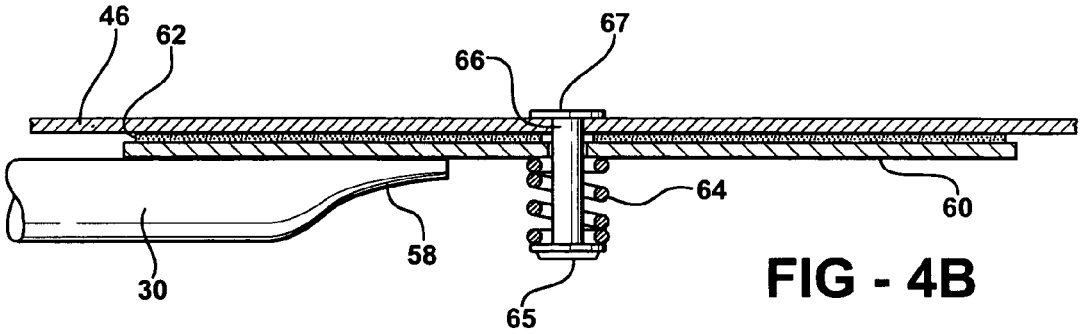
FIG - 4B

ADJUSTABLE BOOK HOLDER ASSEMBLY

CROSS REFERENCE TO RELATED APPLICATIONS

This application claims the benefit of U.S. provisional Ser. No. 60/531,115, filed Dec. 20, 2003.

BACKGROUND OF THE INVENTION

This invention concerns floor supported book holders of the type described in applicant's earlier published application WO99/09859. In this type of book holder a book, magazine, etc., is releasably held on a support piece so as to allow pages of an opened book, magazine, etc., to be conveniently turned and held.

The support piece is itself supported so as to be positioned in various adjusted positions to be viewable when a user is in different positions. For example, the user may be reclining on a bed or sofa and the support is swung over the user and tilted downwardly to various angles as desired. Or, the user may be seated with the holder on one side, the support then positioned tilted upwardly at various angles.

It would be desirable to allow even greater versatility in adjustably positioning the book, magazine, etc., as there are a number of positions into which a user may wish to place the held document that heretofore has not been able to be done by such book holders.

Another consideration is the desirability of minimizing bulk of the holder so as to not be overly obtrusive in the home or office setting.

An attractive appearance is also desirable, as with any other home or office furnishing.

Furthermore, it would be advantageous if the holder assembly could provide additional capabilities for the user.

It is an object of the present invention to provide a floor supported book holder assembly of the type described of improved versatility and utility and having enhanced aesthetic appeal.

SUMMARY OF THE INVENTION

The above objects and other objects which will become apparent upon a reading of the following specification and claims are achieved by a book holder assembly in which a book support is mounted to a swing arm extending from a horizontally extending reversely curved segment of an upper member of an upright assembly. The upright assembly is secured to a weighted base having casters supporting the same on a floor surface. A swing arm pivot connection to a free end of the upper member horizontally extending segment allows tilting of the book support about a horizontal axis. The upper member is rotatable in a lower member to allow the book support to be moved closer or further away to the upright assembly by folding or unfolding the swing arm and horizontally extending segment together or apart.

In addition, the book support is rotationally mounted to the outboard end of the swing arm for adjustable pivoting adjustment about an axis transverse to the longitudinal axis of the swing arm. This mounting may comprise a disc mounted to the swing arm end and urged towards the center of the book support by compression of a spring against an interposed bearing disc by a headed fastener. This arrangement creates a frictional holding force enabling the book support to be secured in any selected pivoted position about the transverse pivot axis.

The book support can thus be pivoted about the axis of the fastener by overcoming the frictional resistance generated by the disc pressed against the rear surface of the support.

This pivoting enables selective positional adjustment of the book support about the transverse axis to an infinite extent, allowing the book holder to be adjusted to be in a horizontal position even if the swing arm sags from horizontal due to heavy weight of the held book. Also, it allows sideways positioning of the book support which may be desired if the user is reclined alongside the book holder assembly to position the held book or magazine sideways.

In addition, by pivoting the book support upside down and then flipping it over about its horizontal axis, the book support can be optionally positioned to the left or the right of the upright without any disassembly.

A separate friction adjustment knob is also provided to enable convenient setting of the friction level stabilizing the upper upright member in any selected position through its swinging range of motion.

The upper member of the upright assembly has a reversely curved segment connected to the vertical straight portion which increases the range of vertical adjustment of the book support position.

Another improvement is the provision of a cast iron platform with a cover placed thereover together forming a weighted base for the book holder assembly which is substantially trimmer and less bulky than the prior design using water filled bags inside the base. At the same time, the cast iron platform allows a more rigid support for the upright assembly.

An optional book shelf-rack support structure is provided slidably emplaceable over the upright assembly to enhance the aesthetic appeal as well as the usefulness of the book holder assembly.

DESCRIPTION OF THE DRAWINGS

FIG. 3 is an enlarged exploded pictorial view of the pivot fitting mounted to the swing arm and a horizontal segment of the upper member of the upright assembly included in the book holder shown assembly in FIG. 1.

FIG. 3A is a fragmented view of one end of a swing arm and on an exploded retention pin used to engage a slot therein.

FIG. 4A is an enlarged pictorial view of the rotatable connection between the book support and swing arm end included in the book holder assembly shown in FIG. 1.

FIG. 4B is a view of the section 4B—4B taken in FIG. 4A.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
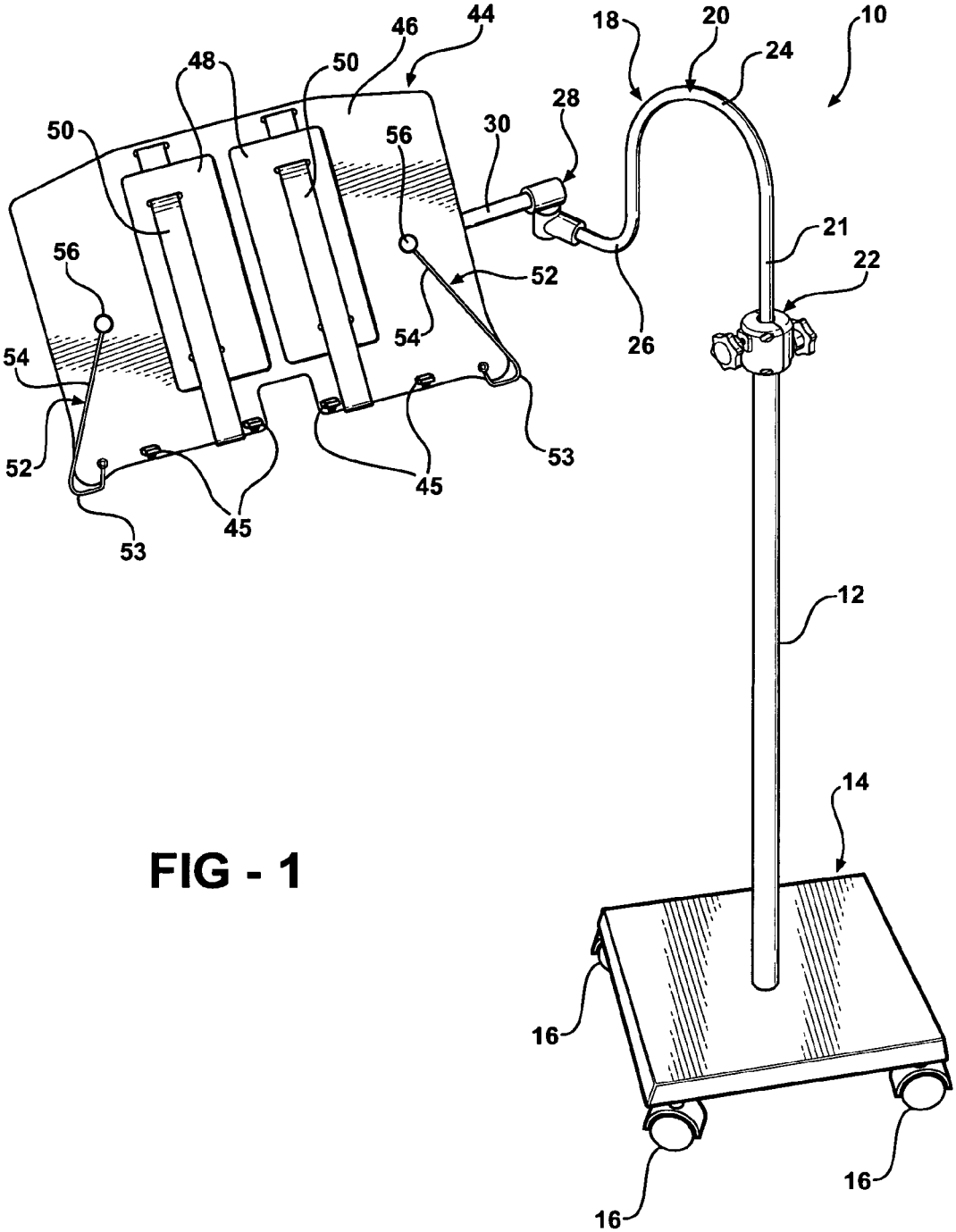
FIG. 1 is a pictorial view of the adjustable book holder assembly according to the present invention.

Referring to FIG. 1, an adjustable book holder assembly 10 according to the present invention has a two part telescoped upright assembly 18 including a lower tubular member 12 secured to a base assembly 14 to be held in an upright vertical position and an upper upright member 20. Four casters 16 on the base assembly 14 rest on a floor surface.

An upper member 20 of the upright assembly 18 includes a vertically extending bottom segment 21 inserted into the lower member 12 and clamped at one end to the upper end of the lower tube member 12 with a clamping assembly 22.

The upper member 20 also includes reversely curved upper segment 24 extending out horizontally from the bottom segment 21, and a straight horizontal end segment 26. A horizontal swing arm 30 is also connected to the straight end 26 by a pivot connection 28 to create an articulation joint allowing the swing arm 30 and segment 26 to be folded towards or away from each other to vary the distance a book support 44 is from the upright assembly 18. For this purpose, the swing arm 30 is of a substantial length, so that the book support 44 is spaced a substantial distance from the pivot connector 28 so as to be able to substantially vary the distance the book support 44 is from the vertical 12 lower member by articulation of swing arm 30 and segment 26. However, this articulation also allows rotation about a horizontal axis by the nature of the pivot connection 28 as described below. The reverse curvature of the segment 24 allows a greater range of height adjustment by the telescoping of the portion 21 into lower member 12, as the book support 44 can be lowered beneath the upper end of the lower upright member 12 as the straight portion 21 is telescoped into the lower upright member 12.

The pivot connection 28 includes a receptacle pivot fitting 32 having a tubular collar 34 attaching it to the straight end segment 26, and a vertical axis seat 36 integral therewith (FIG. 3).

A pivot pin fitting 38 includes a tubular socket 40 rotatably mounting an enlarged end 31 of the swing arm 30 which has a groove 33 receiving a retention screw 35 threaded into the bottom of a hollow vertical axis pivot pin 42 (FIGS. 3 and 3A). The pivot pin 42 is removably received in the pivot seat 36 and fit to be held rotatable therein to create an articulation allowing the swing arm 30 to be swingable relative segment 26 about a vertical axis defined by the hollow pin 42. The swing arm 30 and attached book support 44 to be lifted out without requiring any disassembly. This allows ready removal of one book support and replacement with another having another book held thereon.

The swing arm 30 is also rotatable in the socket 40 about its own longitudinal axis to allow tilt adjustment of the book support 44 about a horizontal axis.

Referring to FIG. 1, the straight horizontal segment 26 of the upper member 18 can be rotated horizontally about a vertical axis defined by the lower upright member 12 and clamp assembly 22. This creates an articulation capability of the swing arm 30 and segment 20 allowing them to be folded together or apart, in turn enabling an adjustment of the horizontal position of the book support 44 mounted to the free end of the swing arm 30. Thus, the book support 44 can be drawn horizontally closer or further away from the vertical axis defined by the lower tube member 12 as desired to decrease or increase the distance from the upright to the book support 44.

The book support 44 in the example shown comprises a roughly rectangular generally planar stiff support piece 46 made of plastic, wood, metal or other rigid material and having a pair of plates 48 each held with an encircling strap 50 threaded through a respective set of slots in the piece 46 and the plates 48 as shown. Other configurations may be used, such as a V-shaped support piece.

The plates 48 each hold a front or back cover as well as some of the pages of a book, magazine, or other document to hold the book, magazine, etc., on the book support 44.

The term "book" is here used in its broadest sense to refer to books, magazines, and other multi-page documents or even a single page document, such as a chart, etc.

A pair of angled page wires 52 have one end of a first segment 53 attached to the piece 46 with a second segment 54 extending over one end of the front surface thereof. A ball tip 56 is affixed to the free end of each page holder second segment 54. The page wires 52 may be made of music wire and heat treated to have memory like a spring.

As described in WO 99/09859, successive book pages can be conveniently turned and secured beneath a ball tip 56 by resilient deflectability of the second segment 54 allowing the same to be pulled out to turn pages and then upon release urging a ball tip 56 back into contact therewith. The friction is set to blow a single page to be slipped out from under a ball tip 56, but prevents the page from turning on its own.

Support piece 46 of the book support 44 may be made sufficiently large (approximately 16×20 inches) to accommodate most sizes of documents desired to be held such as books, magazines, brochures, catalogs, etc., in the opened condition. Smaller sized pieces 46 may be provided as for use with paperbacks only.

A series of integral protrusions 45 are arranged along and cantilevered out from the bottom of the book support piece 44.

The outboard free end 58 of the swing arm 30 is flattened and welded or otherwise affixed to a disc 60 (FIGS. 4, 4A).

The disc 60 is in turn urged towards the support piece 46 and against an interposed bearing disc 62 by a spring 64 compressed beneath the head 65 of a retention pin 66 passing through a centrally located hole in the piece 46. A second head 67 retains the pin 66. The bearing disc 62 is also in turn urged against the rear surface of the piece 46 to create a frictional engagement resisting rotation of the support piece 46 about the pin 66.

However, a user can adjust the orientation of the book support 44 by exerting sufficient turning force thereon to overcome the friction and turn the support 44 to another adjusted position. The axis of adjustment is defined by the pin 66 and thus extends normally to the plane of the book support 44 and transversely to the longitudinal axis of the swing arm 30. The book support 44 can only be rotated with respect to the swing arm on the pin 66 in the plane of the book support 44 as the tilt adjustment is accomplished by rotation of the swing arm 30 itself about its longitudinal axis.

Figure 6:
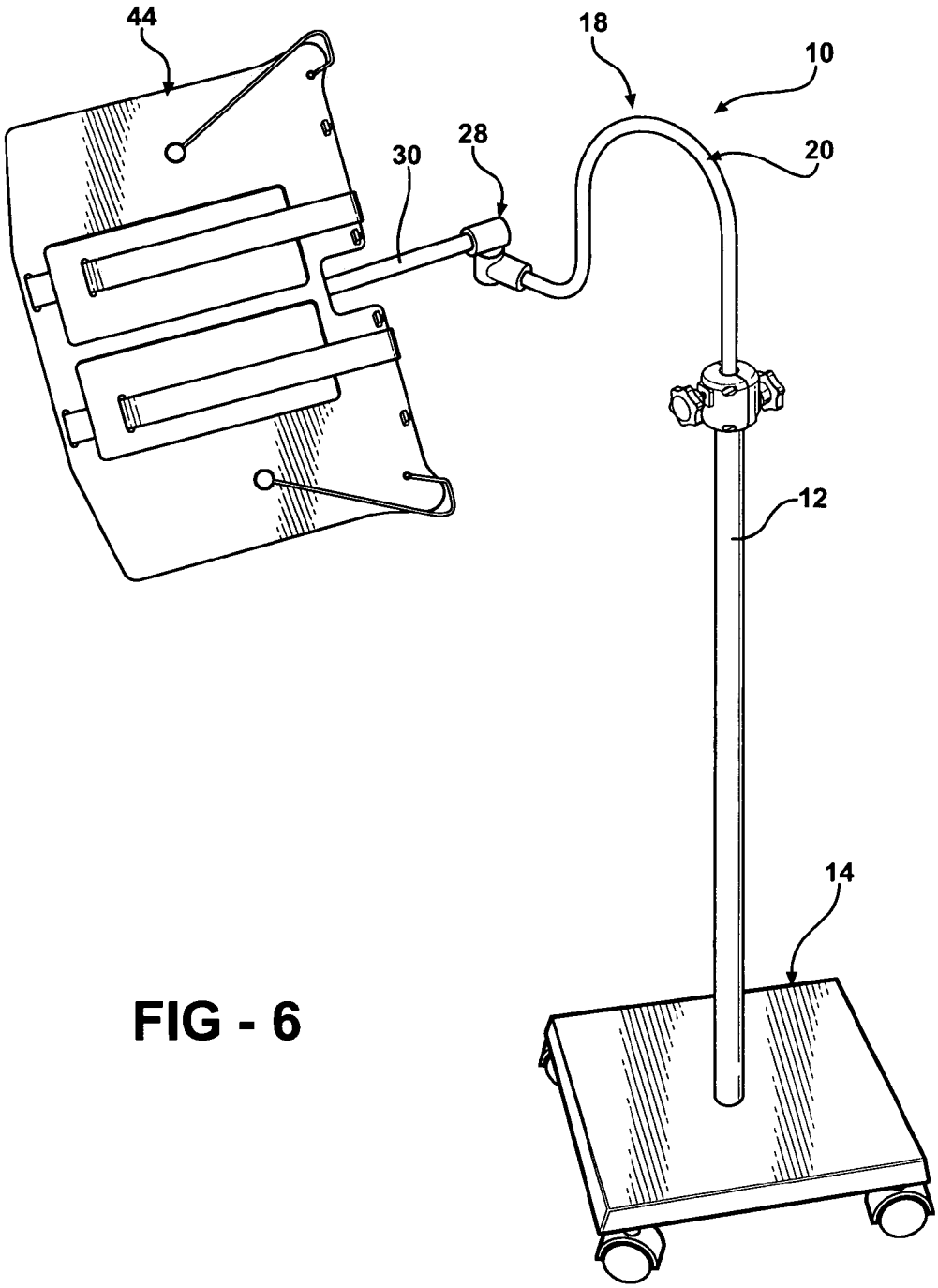
FIG. 6 is a pictorial view of a book holder assembly according to the present invention, showing the book support adjusted into a sideways position.

Thus, the book support 44 can be turned sideways, as seen in FIG. 6, to any desired angle. This allows the book support 44 to be repositioned to be horizontal if the swing arm 30 sags from the weight of a held book or if the base assembly 14 is resting on an uneven floor. Also, it enables sideways positioning of an opened book so that a person can read a book, magazine, etc., while reclining and facing one side of the bed, couch, etc.

This point connection also allows repositioning the book support 44 to the right or left of the lower upright member 12 without disassembly. This is done by pivoting the book support 44 upside down, swinging the same to the other side of the member 12, and then flipping the book support 44 to reverse its position to be forward of the swing arm 30.

This pivot capability also allows reorienting the support piece 46 to enable viewing of documents which are larger in the vertical direction than usual (such as newspapers) or are bound at the top or bottom and thus further enhances the utility of the book holder assembly 10.

Figure 2:
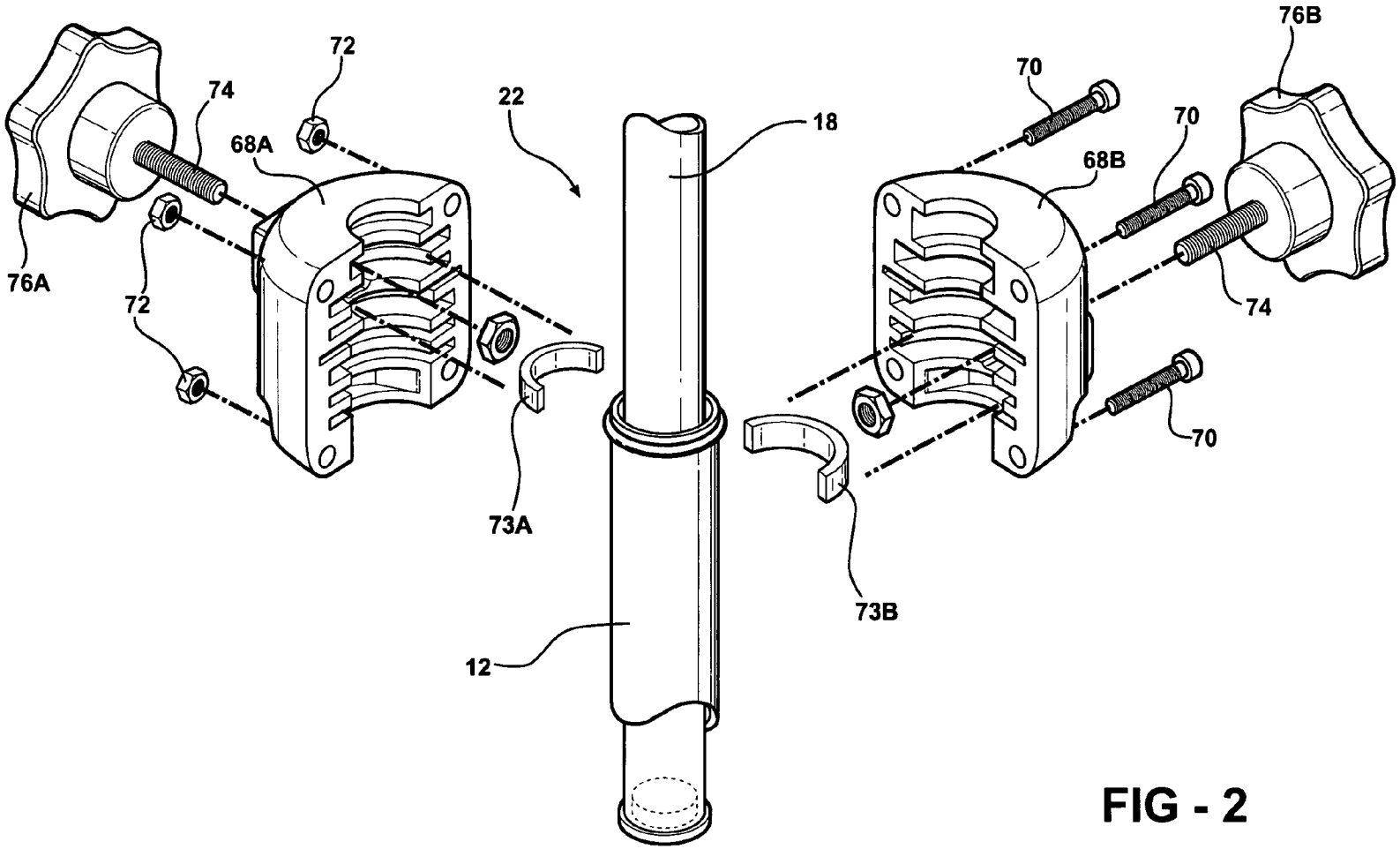
FIG. 2 is an enlarged exploded pictorial view of the upright assembly clamping connection incorporated in the book holder assembly shown in FIG. 1.

As shown in FIG. 2, the clamp assembly 22 includes a split sleeve, with two half moon pieces 68 held together with members 20, 12 of the upright assembly 18 clamped therebetween by screws 70 and nuts 72 and threaded rods 74 affixed to knobs 76A, 76B. Curved pieces 73A, 73B are sized to fit to the upper member 20 and lower member 12, respectively. By loosening rotation of the lower knob 76B, the upright member 20 can turn to swing the horizontal segment 20 of the upper member 20 to position the book support piece 44 with respect to the base 14 as desired. Also any degree of friction grip can be selectively set by turning the lower knob 76B to make it harder or easier to swing the book support about the vertical axis defined by the lower member 12.

Loosening the upper knob 76A, frees the upper member 20 of the upright to be raised (or lowered) within the lower member 12.

Figure 5:
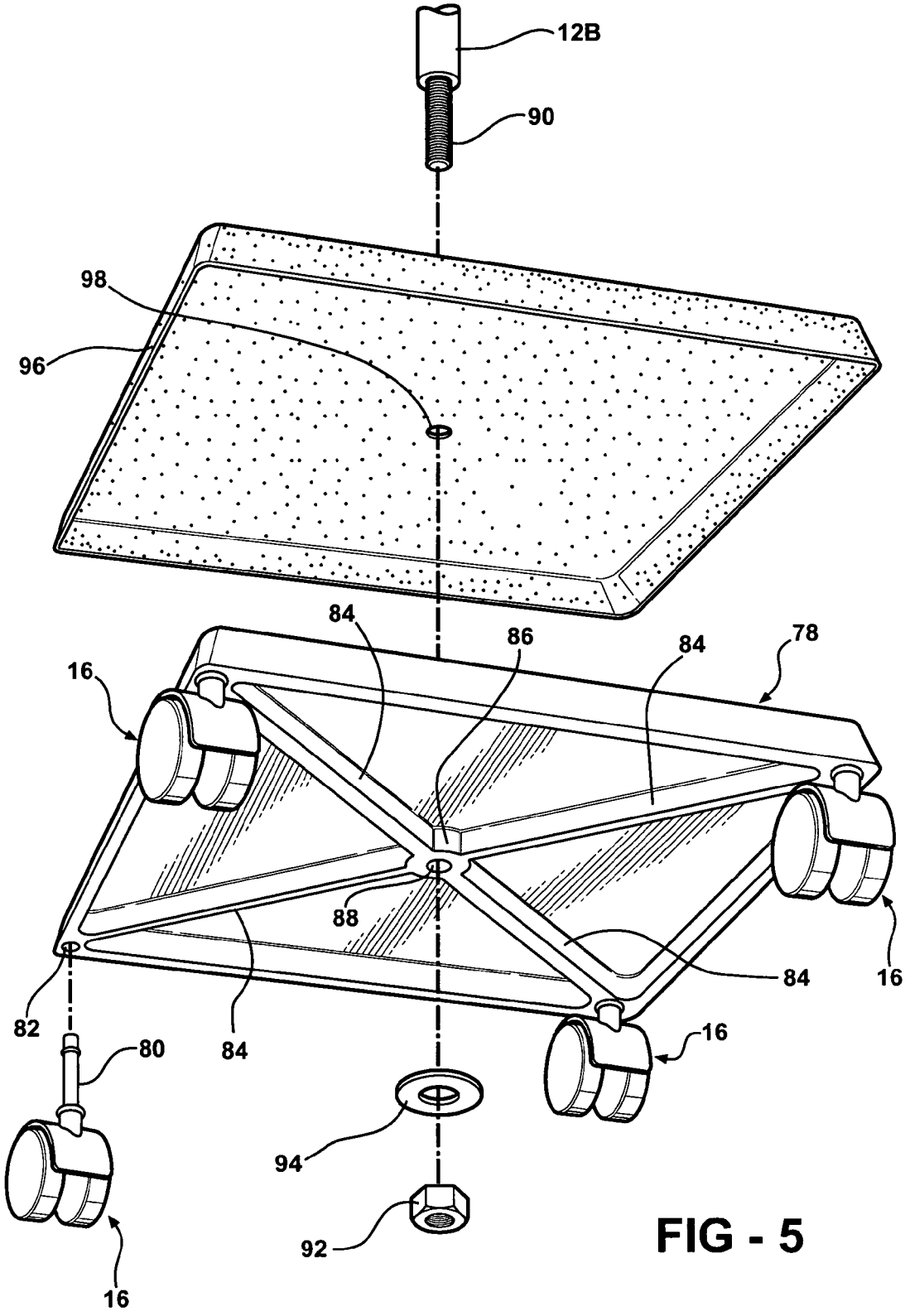
FIG. 5 is an exploded pictorial view of the base components included in the book holder assembly shown in FIG. 1, with a fragmentary portion of the lower member of the upright assembly also included.

The base assembly 14 includes a mounting platform 78 of cast iron having molded bores 82 into which are fit a pivot pin mount 80 of each caster 16 (FIG. 5).

Integral stiffening ribs 84 converge at the center, with a boss 86 formed with a bore 88 receiving a threaded end 90 of the lower upright member bottom end 12B, retained by a nut 92 and washer 94. The ribs 84 keeps the platform 78 from deforming during cooling of the casting to insure a flat surface.

A molded plastic cover 96 is configured to be received atop the platform 78, a bore 98 thereby aligned with bore 86 to allow passage of the threaded end 90. The cover 96 can also be made of wood, metal, etc.

Figure 7:
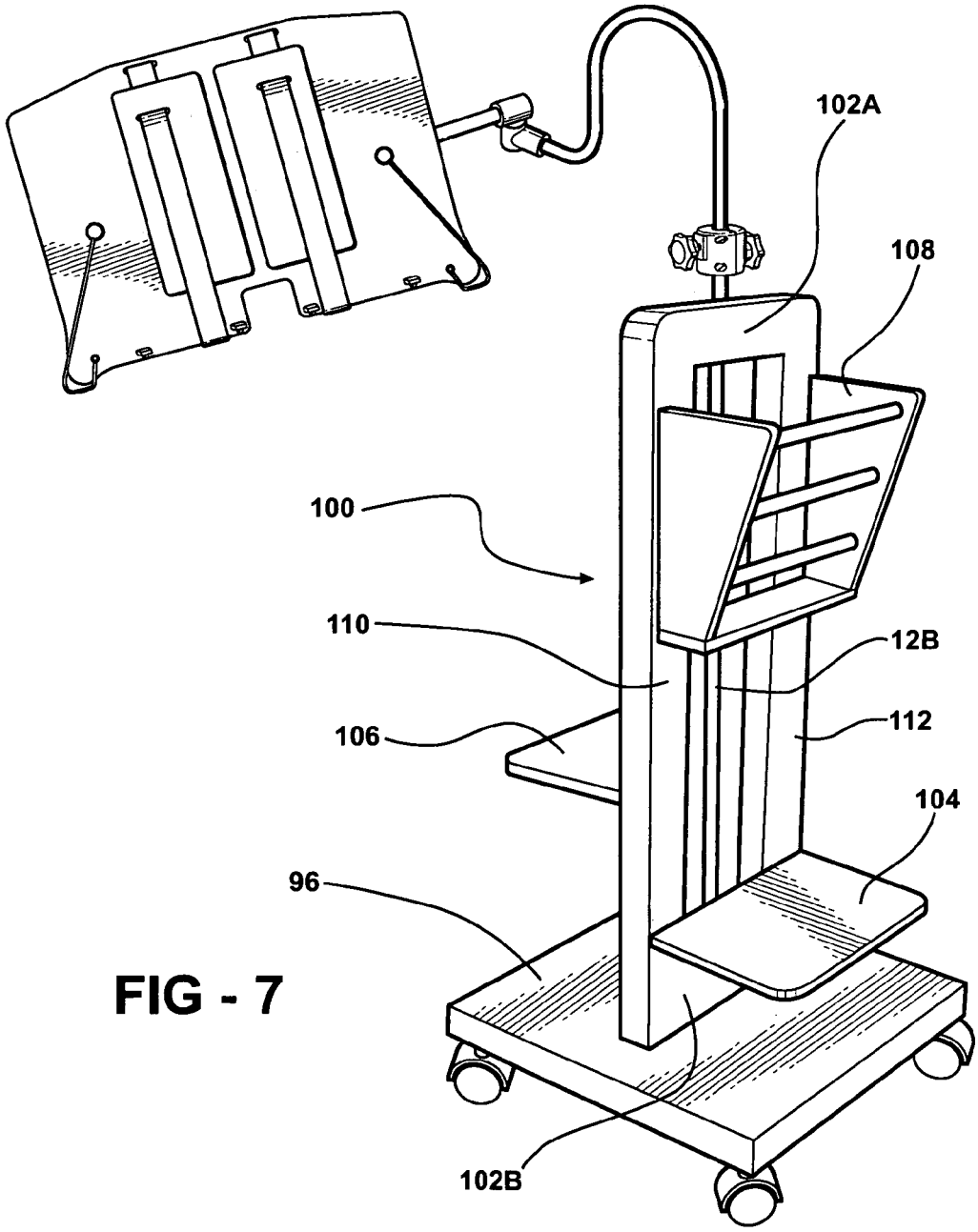
FIG. 7 is a pictorial view of a book holder assembly according to the present invention with an optional book shelf-rack support structure installed thereon.

FIG. 7 shows a book rack-shelf support structure 100 having upper and lower pieces 102A, 102B having aligned bores receiving the lower upright member 12. The book rack-shelf structure 100 rests atop the platform 78 base assembly 14, and two or more shelves 104, 106, and a magazine rack 108 are affixed to side rails 110.

The book holder assembly 10 described above is very convenient in use, freely allowing many positional and orientation adjustments to be made to the book support to accommodate any conceivable desired of the user without requiring disassembly or the manipulation of knobs, etc., other than the loosening of the knob 76A for height adjustment. Also, the book support 44 can be simply swung out of the way to enable the user to move past the same without disturbing most of the adjustments, nor moving the book holder assembly itself.

The invention claimed is:

1. An adjustable position book holder assembly comprising:

a base;

an upright assembly mounted to said base to project upwardly therefrom;

said upright assembly including an upper member having a portion telescoped into a vertical lower member also included in said upright assembly to be rotatable therein, said upper member having a horizontal segment extending laterally from a vertical segment telescoped into said lower member of said upright assembly;

a pivot fitting including a swivel element defining a vertical axis attached to a free end of said horizontal segment of said upper member;

a swing arm having a pivot fitting affixed at one end including a swivel joint element fixed to one end mated to said swivel element of said pivot fitting of said horizontal segment of said upper member so as to orient said swing arm substantially horizontally and allow create a pivot connection allowing horizontal swinging motion thereof about said vertical axis defined by said swivel element to create an articulation of said swing arm and horizontal segment in which the swing arm and horizontal segment are able to relatively move to be folded together and apart by said swinging motion of said swing arm;

said pivot fitting connection also allowing rotation of said swing arm one end about a longitudinal axis thereof;

a generally planar book support mounted to an opposite end of said swing arm;

said swing arm of a substantial length to space said book holder a substantial distance from said pivot connection to allow a substantial variation in the distance said book support lies from said vertical lower member by folding articulation of said swing arm and said horizontal segment; and a frictional pivot connection between said book support and said opposite end of said swing arm allowing rotation of said book support on said swing arm only in the plane of said book support and about an axis transverse to said longitudinal axis of said swing arm to enable reorienting of said book support about an axis normal to the book support.

2. The book holder assembly according to claim 1 wherein said frictional pivot connection includes an adjustable friction engagement allowing positioning of a variable frictional force holding said book support in any rotated position thereof about said frictional pivot connection.

3. The book holder assembly according to claim 2 wherein said adjustable friction engagement includes a disc fixedly attached to said swing arm opposite end and flat against a surface of said book support, and a headed pin passed through said disc and a plate member included in said book support and a spring forcing said disc and plate together.

4. The book holder assembly according to claim 3 further including a friction disc interposed between said plate and said disc caused to frictionally engage both said plate and said disc by said spring.

5. An adjustable position book holder assembly comprising:

a base;

an upright assembly mounted to said base to project upwardly therefrom;

said upright assembly including an upper member having a portion telescoped into a vertical lower member also included in said upright assembly to be rotatable therein, said upper member having a horizontal segment extending laterally from a vertical segment telescoped into said lower member of said upright assembly;

a pivot fitting including a swivel element defining a vertical axis attached to a free end of said horizontal segment of said upper member;

a swing arm having a pivot fitting affixed at one end including a swivel joint element fixed to one end mated to said swivel element of said pivot fitting of said horizontal segment of said upper member so as to orient said swing arm substantially horizontally and allow create a pivot connection allowing horizontal swinging motion thereof about said vertical axis defined by said swivel element to create an articulation of said swing arm and horizontal segment in which the swing arm and horizontal segment are able to relatively move to be folded together and apart by said swinging motion of said swing arm;

said pivot fitting connection also allowing rotation of said swing arm one end about a longitudinal axis thereof;

a generally planar book support mounted to an opposite end of said swing arm;

said swing arm of a substantial length to space said book holder a substantial distance from said pivot connection to allow a substantial variation in the distance said book support lies from said vertical lower member by folding articulation of said swing arm and said horizontal segment; and said base comprising a cast iron platform member, and a molded plastic cover received thereover.

6. The book holder assembly according to claim 5 wherein said platform member has a series of radial ribs formed therein converging to a central bore.

7. An adjustable position book holder assembly comprising:

a base;

an upright assembly mounted to said base to project upwardly therefrom;

said upright assembly including an upper member having a portion telescoped into a vertical lower member also included in said upright assembly to be rotatable therein, said upper member having a horizontal segment extending laterally from a vertical segment telescoped into said lower member of said upright assembly;

a pivot fitting including a swivel element defining a vertical axis attached to a free end of said horizontal segment of said upper member;

a swing arm having a pivot fitting affixed at one end including a swivel joint element fixed to one end mated to said swivel element of said pivot fitting of said horizontal segment of said upper member so as to orient said swing arm substantially horizontally and allow create a pivot connection allowing horizontal swinging motion thereof about said vertical axis defined by said swivel element to create an articulation of said swing arm and horizontal segment in which the swing arm and horizontal segment are able to relatively move to be folded together and apart by said swinging motion of said swing arm;

said pivot fitting connection also allowing rotation of said swing arm one end about a longitudinal axis thereof;

a generally planar book support mounted to an opposite end of said swing arm;

said swing arm of a substantial length to space said book holder a substantial distance from said pivot connection to allow a substantial variation in the distance said book support lies from said vertical lower member by folding articulation of said swing arm and said horizontal segment; and said upper member rotatable in said lower member.

8. The book holder assembly according to claim 7 further including a f clamp comprising a pair of half moon pieces selectively engaged with said upright assembly upper and lower members, said clamp having two threaded knobs having a threaded stem engaging a respective side of said two half moon pieces to secure rotative and telescoped position of said upper member relative to said lower member by tightening said knobs.

9. An adjustable position book holder assembly comprising:

a base;

an upright assembly mounted to said base to project upwardly therefrom;

said upright assembly including an upper member having a portion telescoped into a vertical lower member also included in said upright assembly to be rotatable therein, said upper member having a horizontal segment extending laterally from a vertical segment telescoped into said lower member of said upright assembly;

a pivot fitting including a swivel element defining a vertical axis attached to a free end of said horizontal segment of said upper member;

a swing arm having a pivot fitting affixed at one end including a swivel joint element fixed to one end mated to said swivel element of said pivot fitting of said horizontal segment of said upper member so as to orient said swing arm substantially horizontally and allow create a pivot connection allowing horizontal swinging motion thereof about said vertical axis defined by said swivel element to create an articulation of said swing arm and horizontal segment in which the swing arm and horizontal segment are able to relatively move to be folded together and apart by said swinging motion of said swing arm;

said pivot fitting connection also allowing rotation of said swing arm one end about a longitudinal axis thereof;

a generally planar book support mounted to an opposite end of said swing arm;

said swing arm of a substantial length to space said book holder a substantial distance from said pivot connection to allow a substantial variation in the distance said book support lies from said vertical lower member by folding articulation of said swing arm and said horizontal segment; and said swivel element of said upper member including a socket fixed to said one end of said horizontal segment of said upper member, a separate pin comprising a part of said swivel joint element mounted to said one end of said swing arm and rotatably received in said socket and adapted to be freely liftable therefrom during normal use of the book holder assembly without being disconnected.

10. A book holder assembly according to claim 9 wherein said swivel joint element further includes a tilt pivot socket affixed to said horizontal segment of said upper member free end rotatably receiving said one end of said swing arm captured therein.

11. An adjustable position book holder assembly comprising:

a base;

an upright assembly mounted to said base to project upwardly therefrom;

said upright assembly including an upper member having a portion telescoped into a vertical lower member also included in said upright assembly to be rotatable therein, said upper member having a horizontal segment extending laterally from a vertical segment telescoped into said lower member of said upright assembly;

a pivot fitting including a swivel element defining a vertical axis attached to a free end of said horizontal segment of said upper member;

a swing arm having a pivot fitting affixed at one end including a swivel joint element fixed to one end mated to said swivel element of said pivot fitting of said horizontal segment of said upper member so as to orient said swing arm substantially horizontally and allow create a pivot connection allowing horizontal swinging motion thereof about said vertical axis defined by said swivel element to create an articulation of said swing arm and horizontal segment in which the swing arm and horizontal segment are able to relatively move to be folded together and apart by said swinging motion of said swing arm;

said pivot fitting connection also allowing rotation of said swing arm one end about a longitudinal axis thereof;

a generally planar book support mounted to an opposite end of said swing arm;

said swing arm of a substantial length to space said book holder a substantial distance from said pivot connection to allow a substantial variation in the distance said book support lies from said vertical lower member by folding articulation of said swing arm and said horizontal segment; and said upper member including a reversely curved segment allowing an increased range of telescoping height adjustment of said upper member into said lower member of said upright assembly.

* * * * *